US007389826B2

(12) United States Patent
Linsmeier et al.

(10) Patent No.: US 7,389,826 B2
(45) Date of Patent: Jun. 24, 2008

(54) FIREFIGHTING AGENT DELIVERY SYSTEM

(75) Inventors: Eric R. Linsmeier, Larsen, WI (US); David W. Archer, Hortonville, WI (US)

(73) Assignee: Oshkosh Truck Corporation, Oshkosh, WI (US)

( * ) Notice: Subject to any disclaimer, the term of this patent is extended or adjusted under 35 U.S.C. 154(b) by 169 days.

(21) Appl. No.: 10/951,494

(22) Filed: Sep. 28, 2004

(65) Prior Publication Data

US 2006/0065411 A1 Mar. 30, 2006

(51) Int. Cl.
*A62C 27/00* (2006.01)

(52) U.S. Cl. ..... 169/52; 169/24; 169/43; 169/45

(58) Field of Classification Search ..... 169/22, 169/25, 51, 52, 53; 239/587.1, 587.2, 587.3, 239/587.4, 587.5, 587.6
See application file for complete search history.

(56) References Cited

U.S. PATENT DOCUMENTS

| | | | | |
|---|---|---|---|---|
| 613,910 | A | 11/1898 | Rich | |
| 1,001,863 | A | 8/1911 | Kirkwood | |
| 1,074,165 | A * | 9/1913 | Coutu | 169/25 |
| 1,835,132 | A | 12/1931 | Anania | |
| 2,997,242 | A | 8/1961 | Grosholz | |
| 3,010,533 | A | 11/1961 | Ross | |
| 3,346,052 | A * | 10/1967 | Moore et al. | 169/25 |
| 3,590,946 | A | 7/1971 | Milner, Jr. | |
| 3,599,722 | A | 8/1971 | Davidson et al. | |
| 3,675,721 | A * | 7/1972 | Davidson et al. | 169/24 |
| 3,770,062 | A * | 11/1973 | Riggs | 169/24 |
| 3,789,869 | A * | 2/1974 | Morris | 137/351 |
| 4,007,793 | A * | 2/1977 | Hux et al. | 169/25 |
| 4,103,757 | A | 8/1978 | McVaugh | |
| 4,160,492 | A | 7/1979 | Johnston | |
| 4,456,093 | A | 6/1984 | Finley et al. | |
| 4,565,321 | A | 1/1986 | Vestergaard | |
| 4,678,041 | A | 7/1987 | Staudinger | |
| 4,875,526 | A * | 10/1989 | Latino et al. | 169/24 |
| 5,021,917 | A | 6/1991 | Pike et al. | |
| 5,158,614 | A | 10/1992 | Takeuchi | |
| 5,211,245 | A * | 5/1993 | Relyea et al. | 169/24 |
| 5,301,756 | A * | 4/1994 | Relyea et al. | 169/24 |
| 5,746,396 | A | 5/1998 | Thorton-Trump | |
| 5,788,158 | A * | 8/1998 | Relyea | 239/166 |
| 5,839,664 | A | 11/1998 | Relyea | |
| 5,899,276 | A * | 5/1999 | Relyea et al. | 169/25 |
| 6,755,259 | B2 * | 6/2004 | Peltola et al. | 169/47 |
| 6,779,744 | B1 | 8/2004 | Marine et al. | |
| 2002/0121382 | A1 * | 9/2002 | Fima et al. | 169/53 |
| 2002/0166674 | A1 * | 11/2002 | Kim et al. | 169/52 |
| 2004/0166968 | A1 | 8/2004 | Snider | |

* cited by examiner

*Primary Examiner*—Kevin P. Shaver
*Assistant Examiner*—Trevor E. McGraw
(74) *Attorney, Agent, or Firm*—Foley & Lardner LLP

(57) ABSTRACT

A vehicular firefighting system includes a vehicle, a boom pivotally coupled to the vehicle about a horizontal axis and a nozzle pivotally coupled to the boom. In one embodiment, the system includes a linkage having a first end coupled to the nozzle and a second end coupled to the vehicle such that the linkage maintains an orientation of the nozzle as the boom pivots about the horizontal axis. In another embodiment, the boom forms at least one fluid conduit in fluid communication with the nozzle so as to deliver firefighting agent to the nozzle.

15 Claims, 5 Drawing Sheets

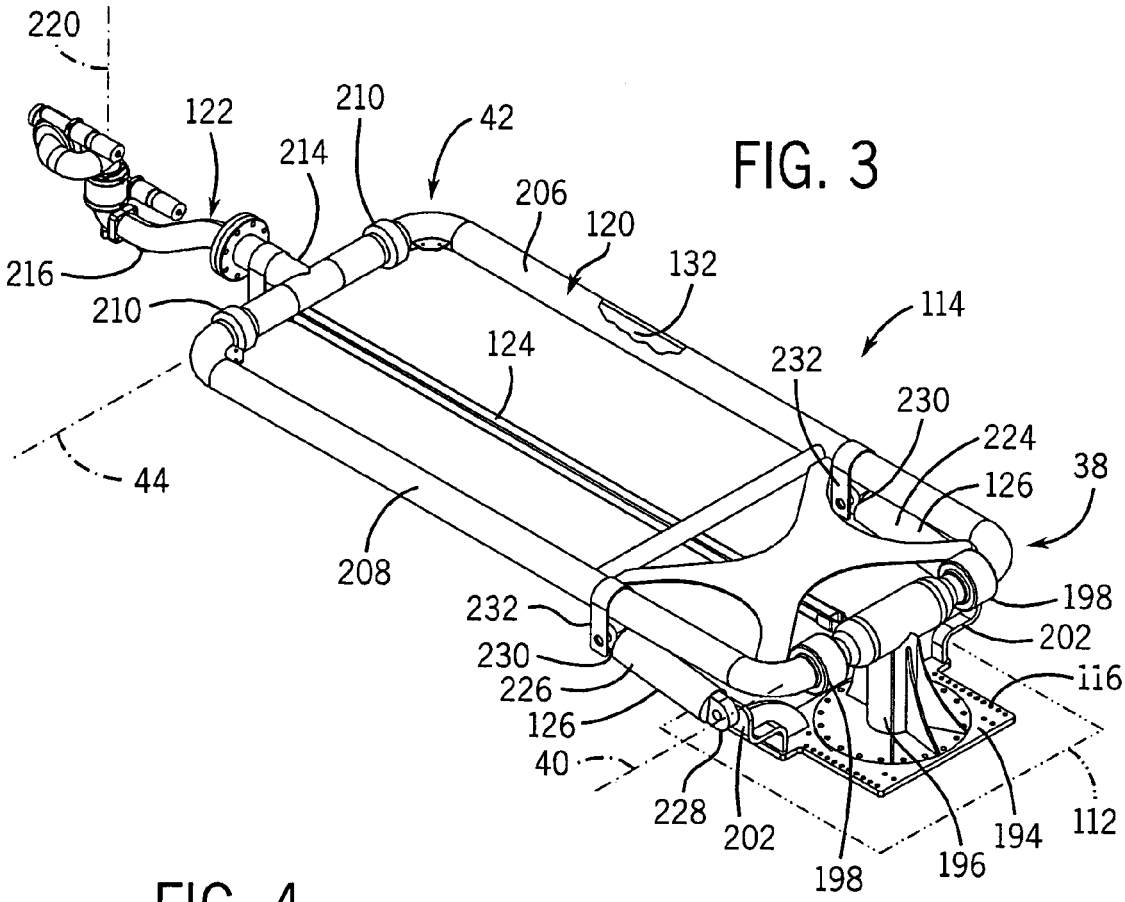
FIG. 3
FIG. 4
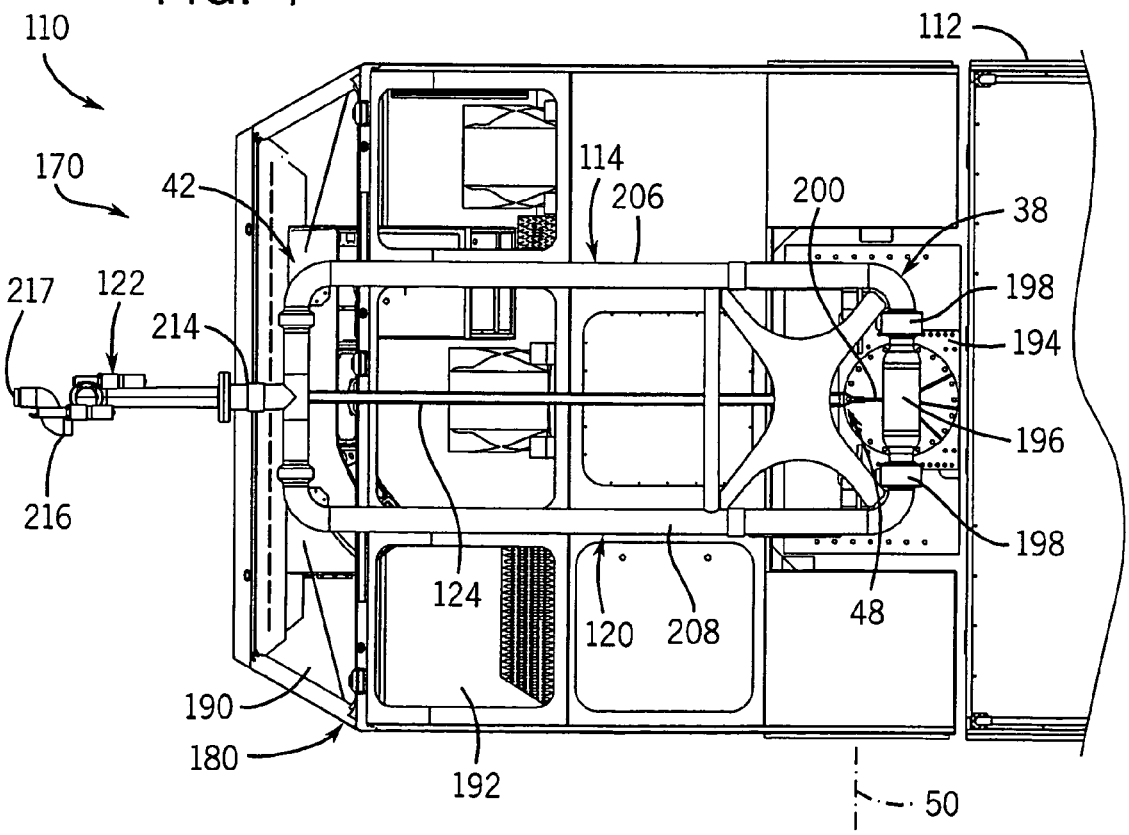

FIREFIGHTING AGENT DELIVERY SYSTEM

BACKGROUND OF THE INVENTION

Various vehicles are known for use in firefighting. Firefighting vehicles, including aerial platform trucks, ladder trucks, pumpers, tankers, etc., often employ a turret for dispensing firefighting agents (e.g., water, foams, foaming agents, etc.), on to areas such as fires, chemical spills, smoldering remains of the fire, or similar areas. Such turrets may include one or more arms to support the firefighting agent dispensing nozzle at one end. The nozzle is supplied with a firefighting agent through a hose or piping is mounted to and extending along one or more arms. The arms typically pivot about a horizontal axis, enabling the nozzle to be raised and lowered.

Although such turrets are quite common, such turrets also suffer from several drawbacks. In some applications, it may be beneficial to maintain the nozzle in a level orientation. Existing turrets utilize a series of complex sensors and control systems, increasing the cost of the turret. In addition, in many applications, it is important that the weight of the firefighting vehicle be within defined limits. The provision of such turrets adds significant weight to the firefighting vehicle.

BRIEF DESCRIPTION OF THE DRAWINGS

FIG. 3 is a top perspective view of a firefighting agent delivery system of the vehicular firefighting system of FIG. 2.

FIG. 4 is a fragmentary top plane view of the vehicular firefighting system of FIG. 2.

DETAILED DESCRIPTION OF EXAMPLE EMBODIMENTS

Figure 1:
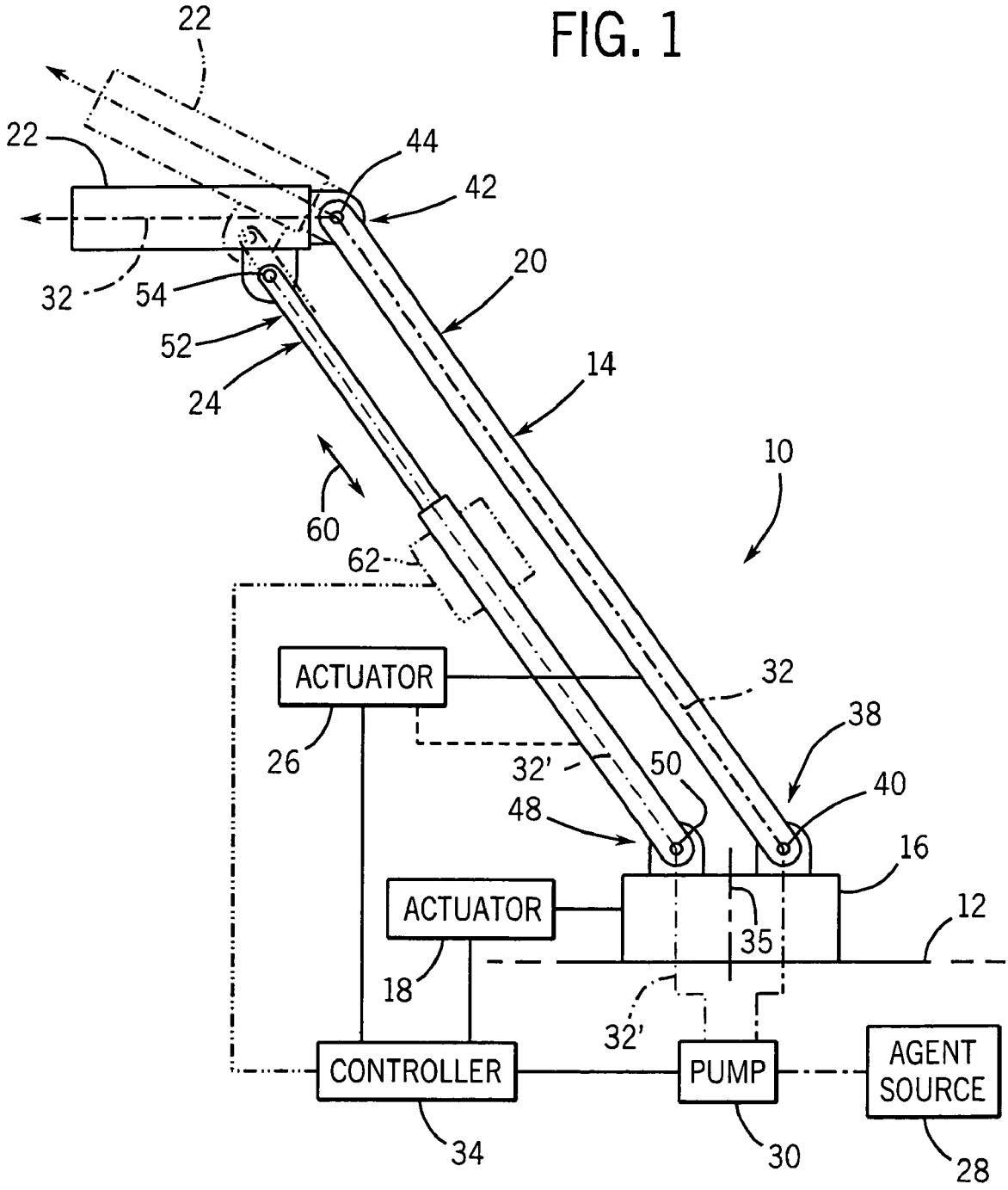
FIG. 1 is a schematic diagram of a vehicular firefighting system according to one exemplary embodiment of the present invention.

FIG. 1 is a schematic illustration of a vehicular firefighting system 10 which generally includes vehicle 12 and firefighting agent delivery system 14. Vehicle 12 comprises any of a variety of numerous vehicles configured to move relative to the ground by various means such as wheels, tracks and the like. In one particular embodiment, vehicle 12 is a self-powered vehicle. In another embodiment, vehicle 12 is configured to be pulled or moved using power from a secondary vehicle. Vehicle 12 supports and carries firefighting agent delivery system 14.

Firefighting agent delivery system 14 delivers a firefighting agent, such as water, foams, foaming agents, dry chemicals and the like, on to areas such as fires, chemical spills, smoldering or active fire or other similar areas. Delivery system 14 includes base 16, actuator 18, boom 20, nozzle 22, linkage 24, actuator 26, agent source 28, pump 30 and conduit 32. Base 16 comprises a structure coupled to vehicle 12 and configured to support boom 20 and linkage 24, as well as nozzle 22, relative to vehicle 12. In the particular embodiment illustrated, base 16 is movable relative to vehicle 12. In one embodiment, base 16 is configured to be rotatably driven about vertical axis 35 , further enabling boom 20, link 24 and nozzle 22 to also be rotated about vertical axis 35 to direct firefighting agent in a particular direction. In one embodiment, base 16 may comprise a platform pivotally supported relative to vehicle 12 by one or more bushing or bearing structures.

Actuator 18 comprises a rotary actuator configured to rotatably drive base 16 about axis 35. In one embodiment, actuator 18 may comprise a hydraulic motor configured to rotate base 16. In another embodiment, actuator 18 may comprise a plurality of hydraulic linear cylinders configured to rotatably drive base 16 about axis 35. In such an embodiment, actuator 18 is powered by a hydraulic pump of vehicle 12. In other embodiments, actuator 18 may comprise other pneumatic, electrical or mechanical systems configured to rotatably drive base 16 about axis 35 and powered by either the engine, the hydraulic or pneumatic pump driven by the engine of vehicle or a separate distinct power source. In still other embodiments, actuator 18 may be omitted wherein base 16 is not configured to rotate relative to vehicle 12.

Boom 20 comprises one or more elongate structures extending from base 16 to nozzle 22. Boom 20 has a first end 38 pivotally coupled to base 16 for pivotal movement about axis 40. Axis 40 is generally horizontal. Boom 20 has a second end 42 pivotally coupled to nozzle 22 for pivotal movement about axis 44. Axis 44 is substantially horizontal. In lieu of pivoting about a single axis, ends 38 and 42 may alternatively be pivotally coupled to base 16 and nozzle 22 by universal joints which permit pivoting about multiple axes.

Nozzle 22 extends from end 42 of boom 20 and is configured to direct or aim the firefighting agent. In one embodiment, nozzle 22 maybe further configured to pierce other structures or hulls for the purpose of injecting the firefighting agent into another structure, hull and the like.

Link 24 comprises one or more elongate structures extending between base 16 and nozzle 22. Link 24 has a first end 48 pivotally coupled to base 16 for pivotal movement about axes 50 and a second end 52 pivotally coupled to nozzle 22 for pivotal movement of axis 54. For purposes of this disclosure, the term "pivotally coupled" shall mean two members are directly or indirectly connected to one another in such a way that at least one member may pivot relative to the other member. In essence, link 24, boom 20, base 16 and nozzle 22 (or extensions from nozzle 22) form a four-bar linkage such that boom 20 and link 24 may be pivoted about axes 40 and 50 to raise and lower the height of nozzle 22 while maintaining the particular orientation of nozzle 22. In the particular example shown, nozzle 22 is maintained in a substantially level or horizontal orientation as it is raised and lowered by the pivoting of boom 20 and link 24.

Actuator 26 comprises a mechanism configured to pivot boom 20 and link 24 about axes 40 and 50 to raise and lower nozzle 22. In the particular examples shown, actuator 26 is coupled to boom 20 so as to pivot boom 20 about axis 40. This results in link 26 also pivoting about axis 50. As indicated by broken lines, actuator 26 may alternatively be directly coupled to link 24 so as to pivot link 24 about axis 50 which results in boom 20 pivoting about axis 40. In the particular example illustrated, actuator 26 comprises a hydraulic or a pneumatic cylinder-piston assembly driven by a hydraulic or pneumatic pump powered by the engine or another power source of vehicle 12. In other embodiments, actuator 26 may comprise other hydraulic, pneumatic, electrical or mechanical arrangements configured to pivot boom 20 and link 24 about axes 40 and 50.

Agent source 28 comprises a source of one or more firefighting agents such as water, foam, fluid chemicals, dry chemicals and the like. In one particular embodiment, agent source 28 comprises a water tank and a foam tank. In another embodiment, agent source 28 may merely comprise a liquid or water tank and one or more valves for supplying the firefighting agent to pump 30. In one embodiment agent source 28 includes a tank of at least 500 gallons and nominally about 3,000 gallons.

Pump 30 comprises a mechanism configured to pump or move a firefighting agent from agent source 28 to conduit 32 and nozzle 22. In one embodiment, pump 30 is driven by torque generated by the engine of vehicle 12. In another embodiment, pump 30 may be driven by a hydraulic or pneumatic system of vehicle 12 which may in turn be driven by the engine or a battery of vehicle 12. In one embodiment, pump 30 is configured to deliver over 1500 gallons per minute at 225 psi.

Conduit 32 generally comprises a fluid passage from pump 30 to nozzle 22. In the particular example shown, conduit 32 is at least partially provided by interior surfaces of boom 20. In other words, at least some portion of the passage through which the firefighting agent travels to nozzle 22 is circumferentially surrounded by one or more structures that are substantially rigid to support the weight of boom 20 and nozzle 22. In one particular embodiment, conduit 32 is formed by the interior surfaces of boom 20 from end 38 to end 42. In one particular embodiment, boom 20 is formed from one or more substantially rigid pieces of tubing, wherein the interior of the tubing provides fluid conduit 32.

As indicated by broken lines, delivery system 14 may alternatively include conduit 32' in lieu of or in addition to conduit 32. Conduit 32' comprises a fluid passage extending between pump 30 and nozzle 22, but through link 24. In such an alternative arrangement, at least portions of link 24 form passage 32'. For example, link 24 may be formed from one or more pieces of tubing through which firefighting agent flows from pump 30 to nozzle 22.

As indicated by broken lines, in the particular embodiment shown, link 24 may alternatively be axially adjustable as indicated by arrows 60 and delivery system 14 may additionally include axial adjustment member 62. For example, link 24 may include two or more elongate members with telescope relative to one another. In another embodiment, link 24 may include two members which extend parallel side-by-side to one another so as to slide relative to one another. Extension and retraction of the individual members of link 24 is adjusted by device 62.

Device 62 comprises a mechanism configured to extend and retract two or more members of link 24. In one embodiment, device 62 may comprise a hydraulic or a pneumatic piston-cylinder assembly, wherein one end of the assembly is connected to a first telescopic member and a second end of the cylinder assembly is connected to a second member of link 24. In still other embodiments, other hydraulic, pneumatic, electrical or mechanical arrangements may be employed to adjust the length of link 24. One example of an electrical device may comprise an electrical solenoid. Adjustment of the length of link 24 may be utilized to adjust an orientation of nozzle 22.

Controller 34 generally comprises a processing unit configured to generate control signals which direct the operation of actuator 18, actuator 26 and pump 30. In those embodiments in which delivery system 14 additionally includes device 62, controller 34 may also be configured to generate control signals which direct the operation of device 62. For purposes of the disclosure, the term "processing unit" shall mean a conventionally known or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. Controller 34 is not limited to any specific combination of hardware circuitry and software, nor to any particular source for the instructions executed by the processing unit. Controller 34 generates such control based upon part upon input from operator controls and/or sensors (not shown) associated with system 10.

Overall, delivery system 14 provides several advantageous features. First, because delivery 14 includes link 24, in addition to boom 20, delivery system 14 automatically maintains an orientation of nozzle 22 as nozzle 22 is raised and lowered. This is achieved without complex and potentially costly sensors and other control mechanism which would otherwise be necessary to maintain a level or other orientation of nozzle 22 as boom 20 and nozzle 22 are raised and lowered.

Second, because conduit 32 is partially formed by one or more structural members also forming boom 20, delivery system 14 is simplified, reducing cost. In particular, delivery system 14 does not require additional hose or piping extending between vehicle 12 and nozzle 22. As a result, the amount of weight that must be raised and lowered by actuator 26 and the weight that must supported by vehicle 12 is reduced. Similar benefits are achieved in alternative embodiments wherein delivery system 14 alternatively or additionally includes conduit 32' partially formed by link 24.

Although FIG. 1 illustrates delivery system 14 incorporating both of the beneficial features noted above, delivery system 14 may alternatively include either one of the aforementioned beneficial features. In one embodiment, delivery system 14 may include link 24 for automatically maintaining a desired orientation of nozzle 22. However, in such an embodiment, conduit 32 may be provided by additional hose, tubing or piping connected to boom 20 or link 24, wherein boom 20 and/or link 24 are structurally independent of the tubing or piping. In still another embodiment, conduit 32 may be provided by surfaces and members which simultaneously form structure components of boom 20, wherein link 24 is omitted. In such an alternative embodiment, delivery system 14 may have sensors and actuators to sense and adjust an orientation of nozzle 22 as boom 20 is raised and lowered.

FIGS. 2-6 illustrate vehicular firefighting system 110, a particular example of vehicle firefighting system 10 shown and described with respect to FIG. 1. System 110 generally includes vehicle 112 and agent system delivery system 114. Vehicle 112 comprises a firefighting vehicle configured to supply and deliver a firefighting agent, such as water, foam or other agents to a point of interest. Vehicle 112 generally includes a front 170, a rear 172, lateral sides 174 and a top 176. Vehicle 112 is a self-propelled vehicle generally including a chassis 178, cab 180 and rear body 182. Chassis 178 generally includes the functional parts of vehicle 112 such as frame 184, suspension (not shown), exhaust system (not shown), brakes (not shown), engine (not shown), transmission (not shown), rear axles (not shown), drive train (not shown), fuel system (not shown), wheels 186, tires 188. In the particular example shown, vehicle 12 additionally includes a central tire inflation system (CTI) 189 (schematically shown) as described in U.S. Pat. No. 5,429,167, the full disclosure of which is hereby incorporated by reference.

Cab 180 is supported by frame 184 and functions as an occupant compartment for vehicle 112. Cab 180 includes a forward and upwardly facing transparent or semi-transparent portion 190 and a transparent or at least semi-transparent roof portion 192 (shown in FIG. 4). Portions 190 and 192 enable all occupants within cab 180 to view the operation and positioning of agent delivery system 114.

Body 182 generally comprises one or more additional structures, including panels, supported by frame 184 and configured to form cargo areas as well as to enclose components of chassis 178. In particular embodiments, body 180 houses and contains storage compartments or tanks for firefighting agents such as water and foam.

Figure 2:
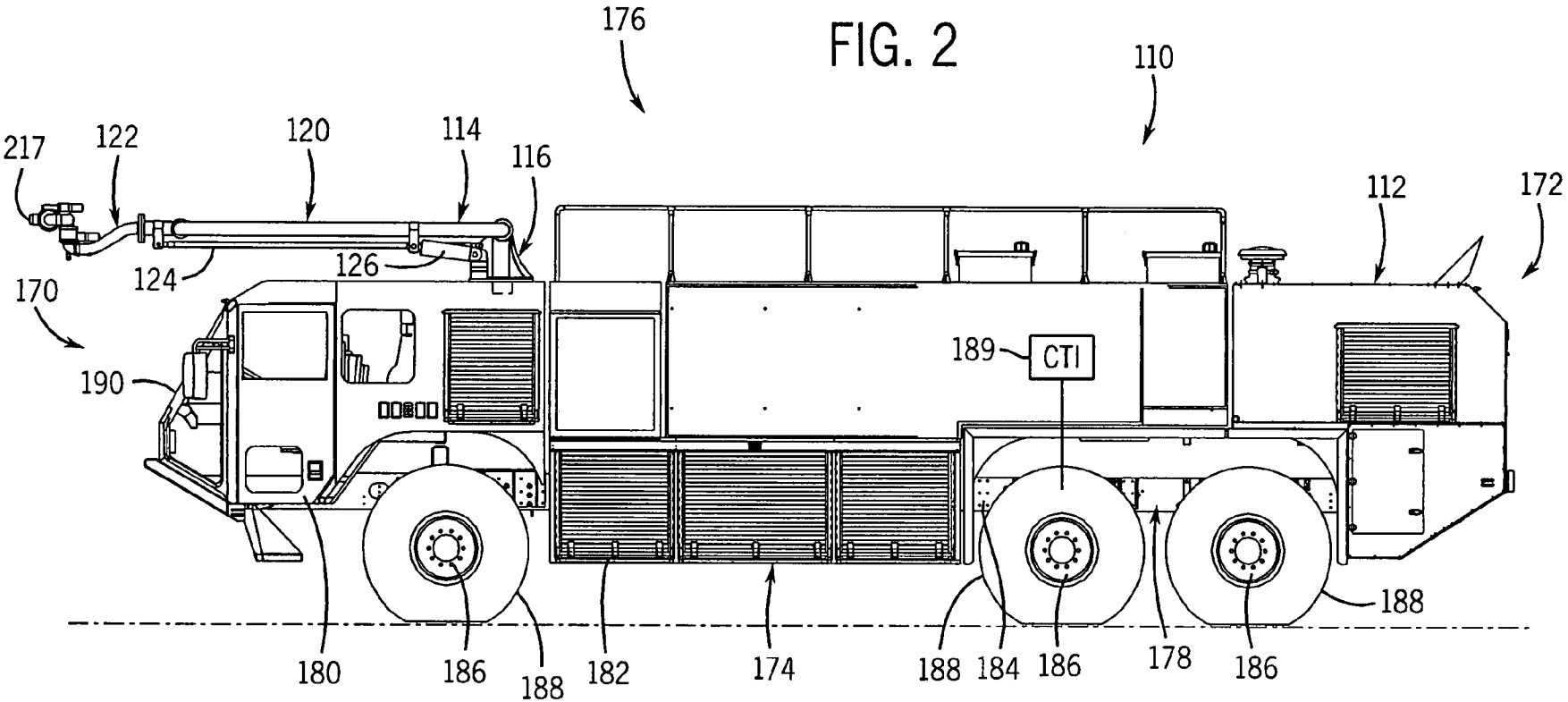
FIG. 2 is a side elevational view of an example of the vehicular firefighting system of FIG. 1.

In the particular embodiment shown, vehicle 112 comprises an airport rescue and firefighting (ARFF) vehicle. Firefighting agent delivery system 114 is similar to firefighting agent delivery system 14 shown and described with respect to FIG. 1. As described with respect to FIG. 1, firefighting agent delivery system 114 includes agent source 28, pump 30 and controller 34. As shown by FIGS. 3 and 4, delivery system 114 additionally includes base 116, boom 120, nozzle 122, link 124 and actuator 126. Base 116 is coupled to vehicle 112 and supports boom 120, link 124 and actuator 126. As best shown by FIG. 2, base 116 is coupled to vehicle 112 at a location rearward of cab 180 and rearward of a front most ground engaging member, such as tire 186 of vehicle 110. In the particular example shown, base 116 is stationarily coupled to vehicle 112 and elevates end 138 of boom 120 above vehicle 112. In the particular example shown, base 116 includes mounting plate 194, support 196, fluid couplers 198 and mounting brackets 200 (shown in FIG. 4) and 202. Mounting plate 194 is fastened or joined to vehicle 112 and serves as a foundation for support 196 and mounting brackets 200, 202. Although mounting plate 194 is shown as being fastened, riveted or bolted to vehicle 112, mounting plate 194 may alternatively be welded or integrally formed as part of vehicle 112. Support 196 is coupled to mounting plate 194 and extends above mounting plate 194 to support end 138 of boom 120 above vehicle 112. In the particular example shown, support 196 is generally T-shaped and defines an internal passage providing a portion of conduit 132 which extends from pump 30 to nozzle 122. In the particular example shown, conduit 132 is also generally T-shaped within support 196. Fluid couplers 198 pivotally connect end 138 of boom 120 to the opposite portions of support 196, enabling boom 120 to pivot about axis 40. In the particular example shown, fluid couplers 198 comprise swivel joints supplied by OPW in Lebanon, Ohio.

Mounting bracket 200 extends from a remainder of base 116 and is configured to be pivotally connected to link 124, enabling link 124 to pivot about axis 50. Mounting brackets 202 are coupled to a remainder of base 116 and pivotally support ends of actuators 126. Although mounting brackets 200 and 202 are illustrated as being coupled to a remainder of base 116, mounting brackets 200 and 202 may alternatively be directly coupled to vehicle 112 in those embodiments in which base 116 is stationarily coupled to vehicle 112. Although support 196 is illustrated as having internal passages forming conduit 132, support 196 may alternatively omit the internal passageways forming a portion of conduit 132, wherein other independent structures are utilized for providing those portions of conduit 132 extending to internal passageways of boom 120 providing conduit 132. Although generally T-shaped, support 196 may have a variety of other alternative shapes and configurations.

Boom 120 extends between base 116 and nozzle 122. Boom 120 serves as a structured cantilevered support for nozzle 122 with respect to base 116. Boom 120 includes a pair of substantially parallel tubes 206, 208 which extend from end 138 to end 142, where tubes 206, 208 are pivotally connected to nozzle 122 pivot couplers 210. Tubes 206 and 208 each include a hollow interior providing a portion of conduit 132. Fluid conduit 132 within tubes 206 and 208 has an internal diameter of at least about 3 inches. Because boom 120 includes parallel tubes 206, 208, boom 120 provides greater support and stability for nozzle 122. Although tubes 206 and 208 are illustrated as comprising generally cylindrical tubes, tubes 206 and 208 may have various other cross sectional shapes. In the particular embodiments, the interior of tubes 206, 208 may be lined with other non-structural materials. Although boom 120 is illustrated as including a pair of parallel tubes, boom 120 may alternatively include a single tube or greater than two tubes.

Tube couplers 210 pivotally connect end 142 of boom 120 to nozzle 122 for pivotal movement about axis 44. At the same time, pivot couplers 210 provide a fluid seal between conduit 132 provided by boom 120 in the interior passageways of nozzle 122. In the particular examples shown, fluid couplers 210 comprise swivel joints supplied by OPW of Lebanon, Ohio.

Nozzle 122 comprises a device having an internal passage in fluid communication with conduit 132. Nozzle 122 is configured to direct firefighting agent supplied by conduit 132 to a point of interest. Nozzle 122 includes a junction portion 214 and agent directing portion 216. Junction portion 214 comprises tubing having an internal passageway in fluid communication with both of tubes 206 and 208 and in fluid communication with the internal passageways of fluid directing portion 216. Fluid directing portion 216 is coupled to junction portion 214 and is configured to direct the firefighting agent to the point of interest. In the particular example shown, fluid directing portion 216 is configured to further pivot about a substantially vertical axis 220. In other embodiments, fluid directing portion 216 may be stationary. In the particular example shown, fluid directing portion 216 is configured to direct a firefighting agent at the minimum rate of 500 gallons per minute and up to the rate of 1,500 gallons per minute. In the particular example shown, fluid directing portion 216 of nozzle 122 comprises a monitor or turret supplied by Akron Brass of Wooster, Ohio Link 124 comprises an elongate bar, rod or other structure (s) having an end 48 pivotally connected to mounting bracket 200 of base 116 and an opposite end 52 pivotally connected to nozzle 122 for pivotal movement about axis 54 (shown in FIG. 5). In other embodiments in which boom 120 is not configured to pivot about a vertical axis relative to vehicle 112, linkage 124 may alternatively be coupled to vehicle 112 at other locations besides base 116. Linkage 124 cooperates with boom 120, base 116 or vehicle 112 and nozzle 122 to form a four-bar linkage. Linkage 124 automatically maintains a particular orientation of nozzle 122 as boom 120 is pivoted about axis 40 to raise and lower nozzle 122.

Actuator 126 comprises a mechanism configured to pivot boom 120 about axis 40. In the particular example shown, actuator 126 comprises a pair of hydraulic cylinder-piston assemblies 224, 226. Assemblies 224 and 226 each have ends 228 pivotally connected to mounting brackets 202 to opposite ends 230 and pivotally connected to projecting brackets 232 of boom 120. Assemblies 224, 226 are in communication with controller 34 (shown and described with respect to FIG. 1) to extend and retract in response to control signals from controller 34. In lieu of comprising hydraulic cylinder-piston assemblies, actuator 126 may alternatively include pneumatic cylinder-piston assemblies, electrical solenoids or other linear actuators. Although actuator 126 is illustrated as including a pair of linear actuators, actuator 126 may alternatively include a single linear actuator or greater than two actuators. Although linear actuator 126 is illustrated as being connected between base 116 and boom 120, actuator 126 may alternatively be connected between base 116 or vehicle 112 and linkage 124 or between base 116 or vehicle 112 and nozzle 122.

Figure 5:
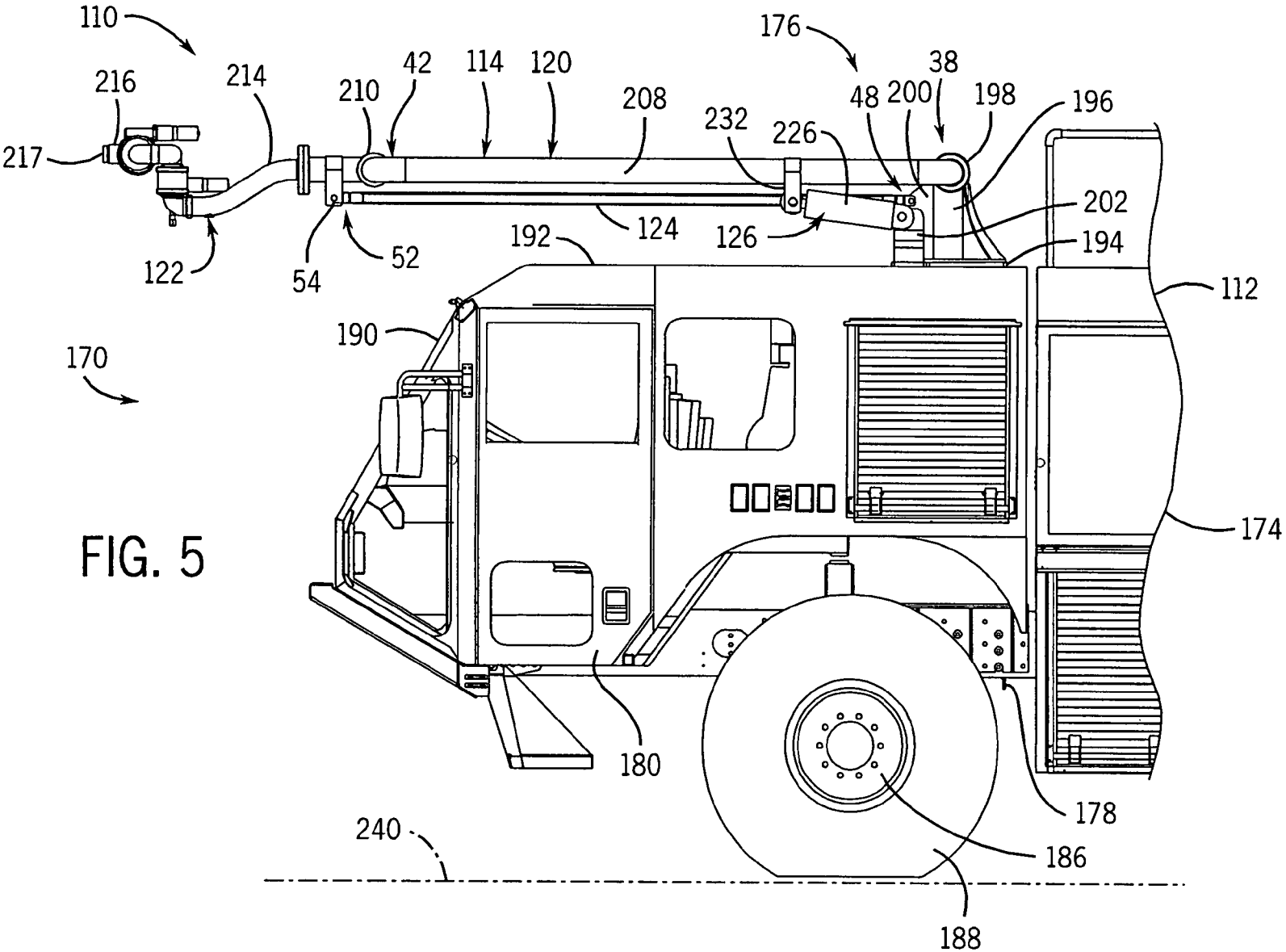
FIG. 5 is a fragmentary side elevational view of the vehicular firefighting system of FIG. 2 illustrating the firefighting agent delivery system in a lowered position.
Figure 6:
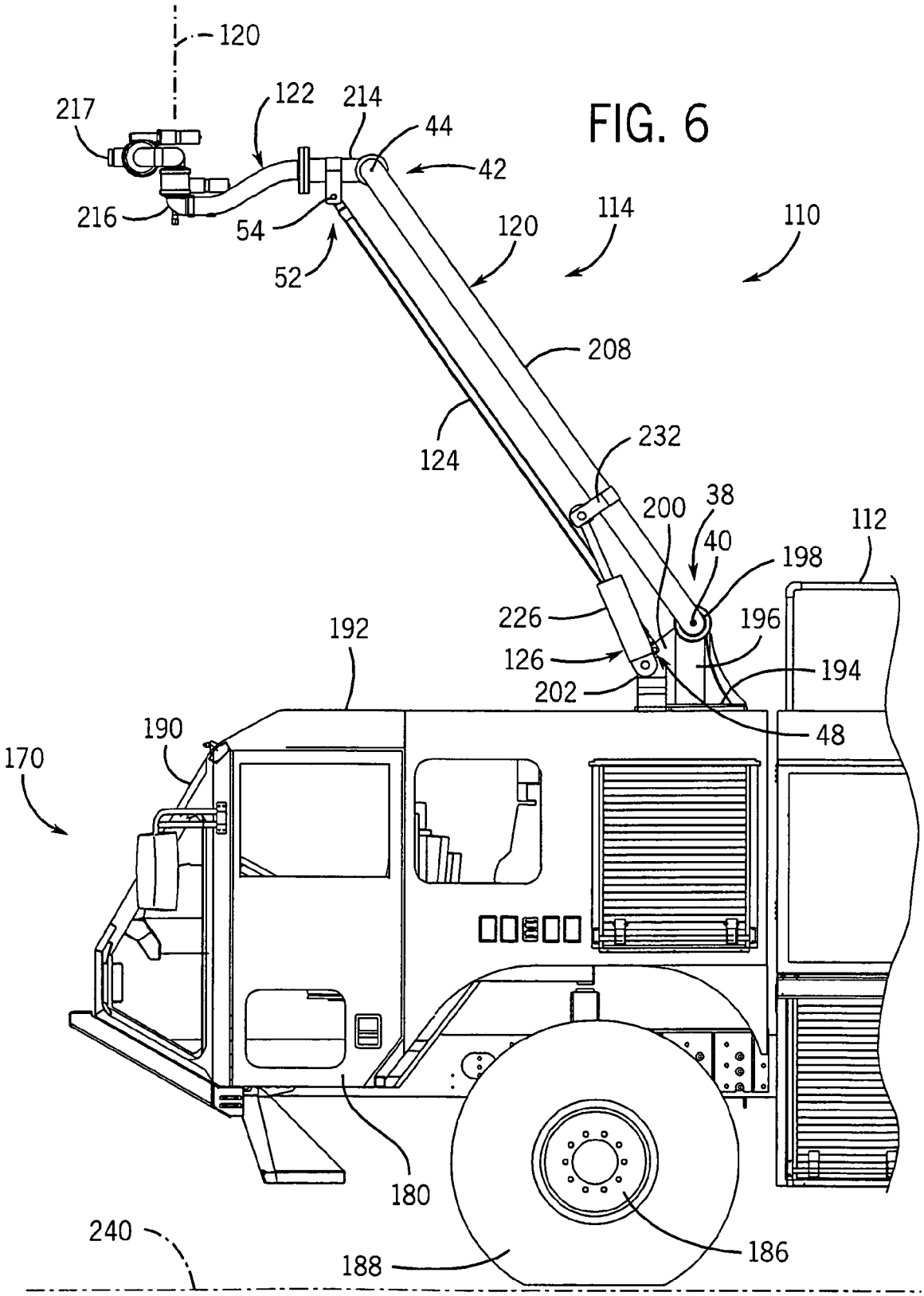
FIG. 6 is a fragmentary side elevational view of the vehicular firefighting system of FIG. 2 illustrating the firefighting agent delivery system in a raised position.

FIGS. 4-6 illustrate the operation of firefighting agent delivery system 114. FIGS. 4 and 5 illustrate firefighting agent delivery system 114 in a forward lowered position. FIG. 6 illustrates delivery system 114 in a raised position. As shown by FIGS. 4 and 5, when delivery system 114 is in the forward, lowered position, tubes 206, 208 of boom 120 extend substantially parallel to ground 240. Nozzle 122, and in particular fluid directing portion 216, are also oriented substantially parallel to ground 240 and in a substantially a level horizontal orientation so as to direct firefighting agent in a forward, substantially horizontal direction. In the lowered position, fluid directing portion 216 and its outlet 217 project forward of end 170 of vehicle 110 beyond portion 190 and beyond cab 180. In the particular example shown, outlet 217 projects forward of cab 180 by at least one foot and nominally about 3 feet. In other embodiments, outlet 217 may project forward of cab 180 by greater distances. Boom 120 is centered along a longitudinal center line of vehicle 110.

As shown by FIG. 6, when agent delivery system 114 is in a raised position, tubes 206, 208 of boom 120 are inclined. At the same time, nozzle 122 and its fluid directing portion 216 maintain the same orientation as when delivery system 114 was in the lowered position. As boom 120 is pivoted about axis 40 in a clockwise direction (as seen in FIG. 6), by actuator 126, linkage 124 causes nozzle 122 to correspondingly pivot about axis 44 in a counterclockwise direction (as seen in FIG. 6) to maintain the orientation of nozzle 122. In the particular example shown, nozzle 122 is maintained in a substantially horizontal orientation and in an orientation parallel to ground 240. In other embodiments, other orientations of nozzle 122 may be maintained by the use of linkage 124.

FIG. 6 illustrates actuator 126 in a fully extended position so as to pivot boom 120 to a raised position of approximately 55 degrees with respect to horizontal. In this raised position, fluid directing portion 216 of nozzle 122 is generally located vertically above portion 190 and 192 of cab 180. As a result, operators within cab 180 may visually ascertain the direction in which the firefighting agent is being dispersed by nozzle 122 to confirm proper operation of delivery system 114. Actuator 126 is configured to selectively reposition and maintain boom 120 at a plurality of intermediate portions between the lowered position shown in FIGS. 4 and 5 and the raised position shown in FIG. 6. For example, actuator 126 may also be configured to position 120 such that tubes 206 and 208 extend within a plane approximately 30 degrees with respect to the horizontal. In particular embodiments, actuator 126 may also be configured to position boom 120 greater than 55 with respect to horizontal. Regardless of the orientation of boom 120, linkage 124 maintains the particular orientation of nozzle 122 without complex sensors or controls. At the same time, because boom 120 may itself, provides fluid conduit 132, the overall weight of delivery system 114 is reduced and the construction of delivery system 114 is simplified to reduce cost and manufacturing complexity.

Although the present invention has been described with reference to example embodiments, workers skilled in the art will recognize that changes may be made in form and detail without departing from the spirit and scope of the invention. For example, although different example embodiments may have been described as including one or more features providing one or more benefits, it is contemplated that the described features may be interchanged with one another or alternatively be combined with one another in the described example embodiments or in other alternative embodiments. Because the technology of the present invention is relatively complex, not all changes in the technology are foreseeable. The present invention described with reference to the example embodiments and set forth in the following claims is manifestly intended to be as broad as possible. For example, unless specifically otherwise noted, the claims reciting a single particular element also encompass a plurality of such particular elements.

What is claimed is:

1. A vehicular firefighting system comprising:

a vehicle;

a boom consisting of a pair of substantially parallel tubes that form a structure for the boom and have a hollow interior that serves as a conduit for passage of a flow of a firefighting agent;

a T-shaped support coupled to the vehicle and having an internal passage for receiving the flow of a firefighting agent from a source and directing the flow to the tubes; the T-shaped support also pivotally coupled to a first end of the tubes for movement of the tubes in a substantially vertical plane;

a junction portion pivotally coupled to a second end of the tubes, the junction portion having an internal passage for the flow of a firefighting agent from the tubes;

a nozzle coupled to the junction portion for discharging the flow of a firefighting agent; and a linkage having a first end pivotally coupled to the nozzle and a second end pivotally coupled to the vehicle, wherein the linkage is configured to maintain an orientation of the nozzle as the boom pivots about the T-shaped support.

2. The system of claim 1, wherein the linkage is configured to maintain the nozzle in a horizontal orientation.

3. The system of claim 1, wherein the linkage has an adjustable length.

4. The system of claim 1 including a base supporting the boom and rotatably coupled to the vehicle.

5. The system of claim 1, wherein the nozzle is configured to pivot about a vertical axis.

6. The system of claim 1, wherein the linkage has a hydraulically adjustable length.

7. The system of claim 1, wherein the T-shaped support includes a first portion coupled to the vehicle and a second portion coupled to one of the tubes and a third portion coupled to the other of the tubes, and the junction portion includes a first portion coupled to the nozzle and a second portion coupled to one of the tubes and a third portion coupled to the other of the tubes.

8. The system of claim 1 including an actuator coupled between the vehicle and the boom and configured to pivot the boom.

9. The system of claim 1, wherein the nozzle extends beyond a front of the vehicle.

10. The system of claim 1, wherein the vehicle includes a cab.

11. The system of claim 10, wherein the cab includes an upwardly facing transparent portion.

12. The vehicle of claim 11, wherein the transparent portion faces in a vertical direction.

13. A firefighting agent delivery system for use with a vehicle, the system comprising:

a support having an internal passage for receiving a flow of a firefighting agent from a source, the support coupled to the vehicle;

a boom consisting of a plurality of tubes coupled to the support; wherein the tubes provide the structure of the boom and have a hollow interior that serves as a conduit for receiving the flow of the firefighting agent from the support and pivotally movable relative to the vehicle about a first horizontal axis and in a substantially vertical plane;

a junction portion coupled to the tubes of the boom for receiving the flow of the firefighting agent from the tubes;

a nozzle coupled to the junction portion for receiving the flow of the firefighting agent from the junction portion and pivotally movable about a second horizontal axis; and a linkage having a first end pivotally coupled to one of the junction portion and the nozzle and a second end pivotally coupled to the vehicle, wherein the linkage is configured to maintain an orientation of the nozzle as the tubes pivot about the first horizontal axis.

14. A method for delivering a firefighting agent from a vehicle, the method comprising:

pivoting a T-shaped support about a substantially vertical axis relative to the vehicle;

moving a boom consisting of a plurality of substantially parallel tubes that serve as the structure for the boom and have an internal passage that serves as a conduit for a flow of a firefighting agent from the T-shaped support, the tubes coupled to the T-shaped support for pivotal movement about a horizontal axis and in a substantially vertical plane relative to the vehicle;

moving the firefighting agent through a conduit formed by the T-shaped support and the tubes to the nozzle; and ejecting the firefighting agent through the nozzle.

15. The method of claim 14 including maintaining an orientation of the nozzle with a linkage having a first end pivotally coupled to the nozzle and a second end pivotally coupled to a base.

* * * * *